US008855533B2

(12) United States Patent
Kim

(10) Patent No.: US 8,855,533 B2
(45) Date of Patent: Oct. 7, 2014

(54) POWER TRANSMISSION APPARATUS AND IMAGE FORMING APPARATUS HAVING THE SAME

(71) Applicant: Hyun-ho Kim, Seoul (KR)

(72) Inventor: Hyun-ho Kim, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 6 days.

(21) Appl. No.: 13/660,087

(22) Filed: Oct. 25, 2012

(65) Prior Publication Data

US 2013/0051885 A1 Feb. 28, 2013

Related U.S. Application Data

(63) Continuation of application No. 12/252,849, filed on Oct. 16, 2008, now Pat. No. 8,315,542.

(30) Foreign Application Priority Data

Jan. 11, 2008 (KR) ..... 10-2008-0003663

(51) Int. Cl.
*G03G 15/00* (2006.01)
*G03G 15/23* (2006.01)

(52) U.S. Cl.
CPC .... *G03G 15/234* (2013.01); *G03G 2215/00675* (2013.01)
USPC ..... 399/167

(58) Field of Classification Search
USPC ..... 399/33, 167, 222, 364, 401
See application file for complete search history.

(56) References Cited

U.S. PATENT DOCUMENTS

| | | | | |
|---|---|---|---|---|
| 4,985,731 | A | 1/1991 | Sakakura et al. | |
| 2005/0184448 | A1 | 8/2005 | Aoyagi et al. | |
| 2007/0284803 | A1 * | 12/2007 | Oomori | 271/10.01 |

FOREIGN PATENT DOCUMENTS

| | | |
|---|---|---|
| KR | 10-1999-0056048 | 7/1999 |
| KR | 1020010027254 | 4/2001 |
| KR | 10-2003-00058301 | 7/2003 |

OTHER PUBLICATIONS

Notice of Allowance Filed on Oct. 29, 2012 in KR Patent Application No. 10-2008-0003663.
Korean Office Action dated May 16, 2012 issued in KR Application No. 10-2008-0003663.

* cited by examiner

*Primary Examiner* — Walter L Lindsay, Jr.
*Assistant Examiner* — Barnabas Fekete
(74) *Attorney, Agent, or Firm* — Stanzione & Kim, LLP

(57) ABSTRACT

A power transmission apparatus and an image forming apparatus are provided. The power transmission apparatus of transmitting driving power to first and second movable members includes a driving unit which receives the driving power from a driving power source, and which rotates in forward and backward directions, a first driven unit which transmits the driving power to the first movable member, an elastic clutch which is provided between the driving unit and the first driven unit to selectively allow the driving power from the driving unit to be conveyed to the first driven unit based on the direction of the driving power, and a second driven unit to convey the driving power to the second movable member regardless of the direction of the driving power so as to allow the second movable member to rotate bi-directionally. The first movable member may be, e.g., a photosensitive body. The second movable member may be, e.g., exit rollers for ejecting processed printing medium out of the image forming apparatus.

22 Claims, 15 Drawing Sheets

POWER TRANSMISSION APPARATUS AND IMAGE FORMING APPARATUS HAVING THE SAME

CROSS-REFERENCE TO RELATED APPLICATION

This application is a continuation of application Ser. No. 12/252,849 filed Oct. 16, 2008 and claims priority from Korean Patent Application No. 10-2008-0003663, filed on Jan. 11, 2008 in the Korean Intellectual Property Office, the disclosure of which is incorporated herein by reference.

BACKGROUND OF INVENTION

1. Field of Invention

Apparatuses and methods consistent with the embodiments of present invention relate to a power transmission apparatus and an image forming apparatus having the same, and more particularly, to a power transmission apparatus for duplex printing and an image forming apparatus having the same.

2. Description of the Related Art

In general, an image forming apparatus receives image data, and forms a visual image thereof on a print medium. Image forming apparatuses have been developed that allow duplex printing function, in which both sides of the print medium are printed.

The image forming apparatus having the duplex printing function generally employs at least two or more motors since the print medium is made to pass through the developing unit once to print the first side of the print medium, and then is returned to the developing unit to pass therethrough for the second time to print the second-side of the print medium. For example, the image forming apparatus includes a developing unit driving motor for driving the developing unit, and a carrying motor that is capable of reversibly rotating to carry the print medium in the reverse direction so the same can return to the developing unit once the printing of the first side has been completed.

A conventional image forming apparatus having the duplex printing function may have to have a plurality of motors, which may contribute to the size and the production costs of the image forming apparatus.

There have been developments to use a single driving motor for both driving the developing unit and returning the print medium to the developing unit in the image forming apparatus having the duplex printing function. For example, there has been developed a structure that the driving motor drives the developing unit to rotate only in the forward direction by a unidirectional hub clutch, but which allows the print medium carrying unit to rotate in both forward and backward directions.

However, in case of the image forming apparatus 1 employing the hub clutch 30 as shown in FIG. 1, vibrations and shock may be generated in the driven gear 20 because of the repulsive force to load occurring when the driving gear 10 rotates. FIG. 2 is a graph showing an amplitude waveform according to frequency jitters of elements, which are generated while forming an image in the image forming apparatus 1 employing the hub clutch 30.

In the graph, an area A showing the peak jitter corresponds to a band around a frequency value of 65 where the frequency is generated by the hub clutch 30. Such a jitter due to the vibration and shock generated by a mating frequency between the hub clutch 30 and the driven gear 20 has an effect on the print image and may deteriorate the print quality.

SUMMARY OF THE INVENTION

Accordingly, it is an aspect of the present invention to provide a power transmission apparatus with reduced number of driving power sources and an image forming apparatus having the same, thereby reducing the size of the image forming apparatus.

Another aspect of the present invention is to provide a power transmission apparatus and an image forming apparatus having the same, in which vibration due to power transmission is decreased to thereby improve print quality.

BRIEF DESCRIPTION OF THE DRAWINGS

The above and/or other aspects of the several embodiments of the present invention will become apparent and more readily appreciated from the following description of the embodiments, taken in conjunction with the accompanying drawings, in which.

DETAILED DESCRIPTION OF SEVERAL EMBODIMENTS OF THE INVENTION

Figure 1:
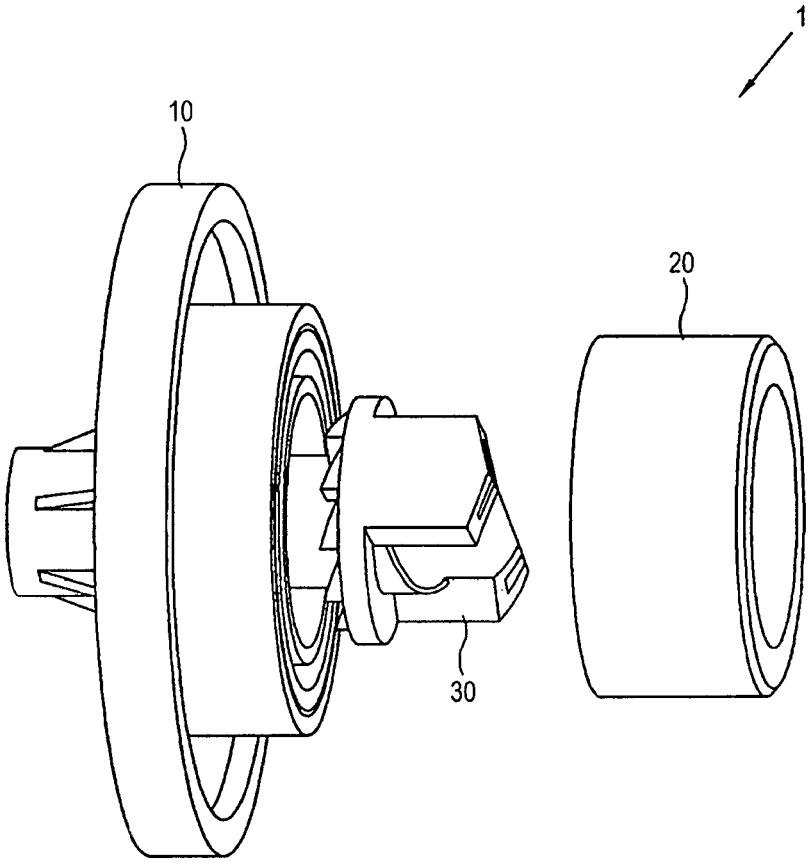
FIG. 1 is a perspective view of a hub clutch used in a conventional image forming apparatus.

Reference will now be made in detail to the embodiments of the present invention, examples of which are illustrated in the accompanying drawings, wherein like reference numerals refer to like elements throughout. The embodiments are described below so as to explain the same by referring to the figures.

Figure 3:
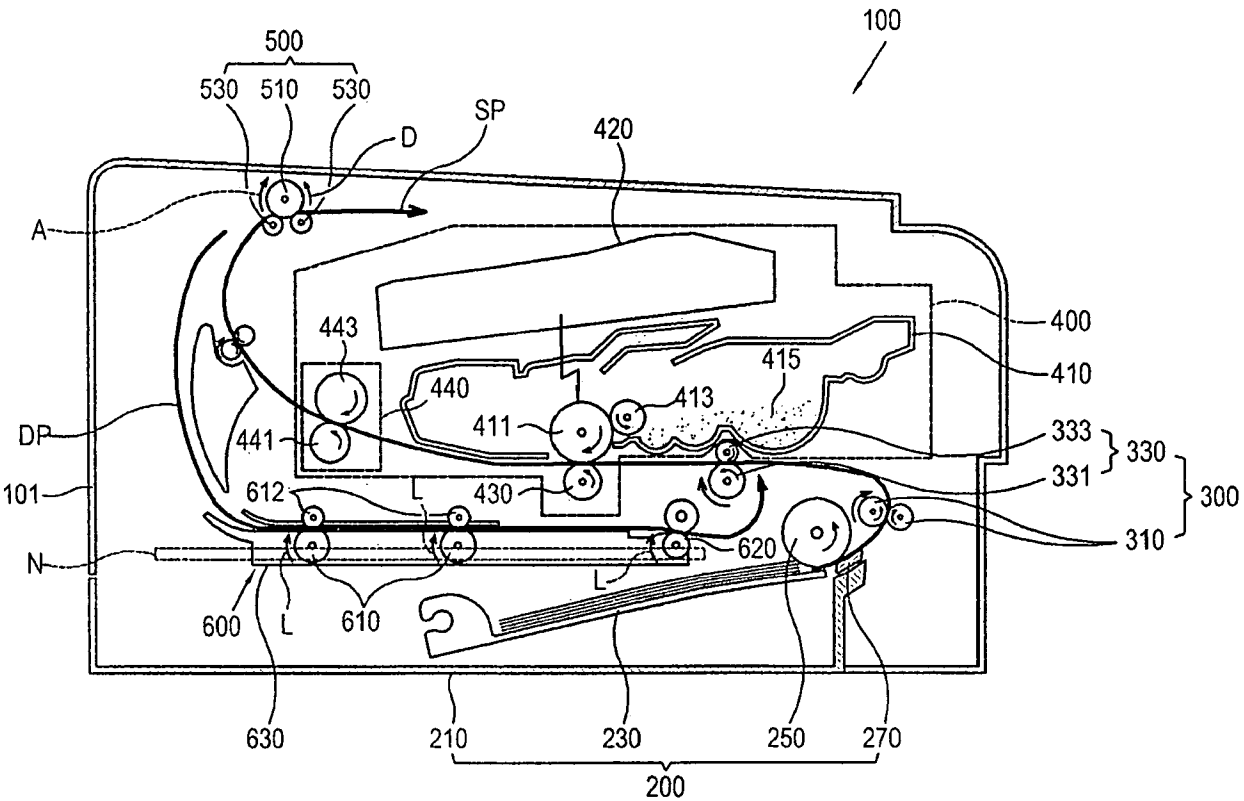
FIG. 3 is a schematic view of an image forming apparatus according to an embodiment of the present invention.
Figure 4:
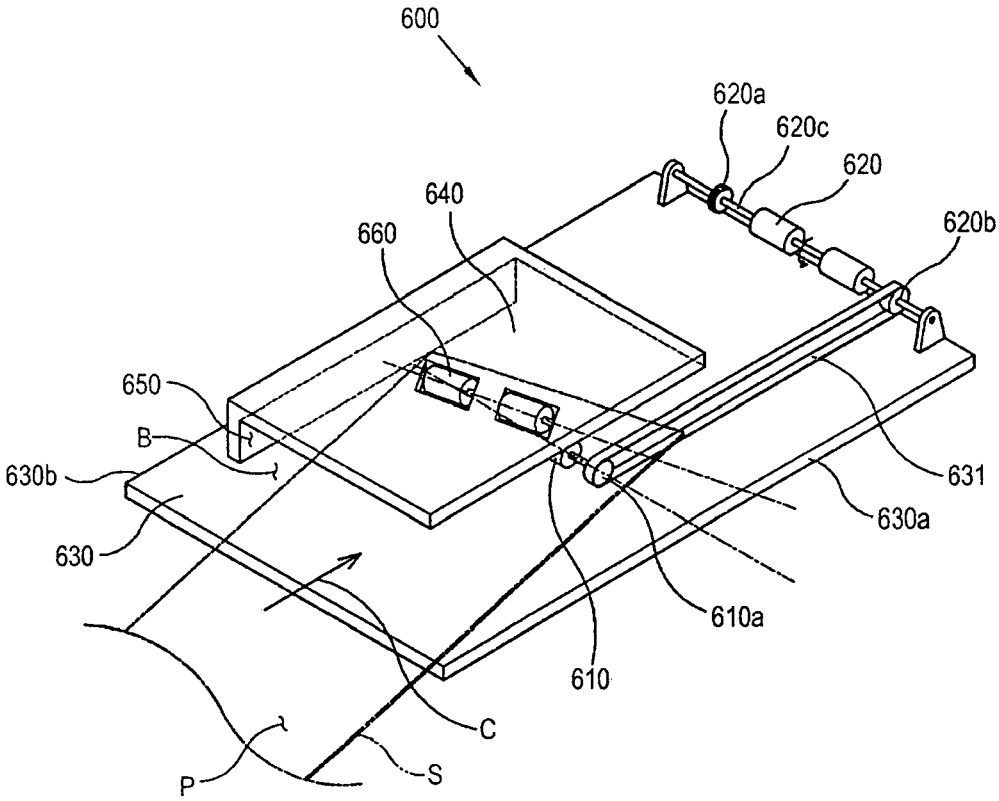
FIG. 4 is a schematic perspective view of a duplex carrying unit according to an embodiment of the present invention.
Figure 5:
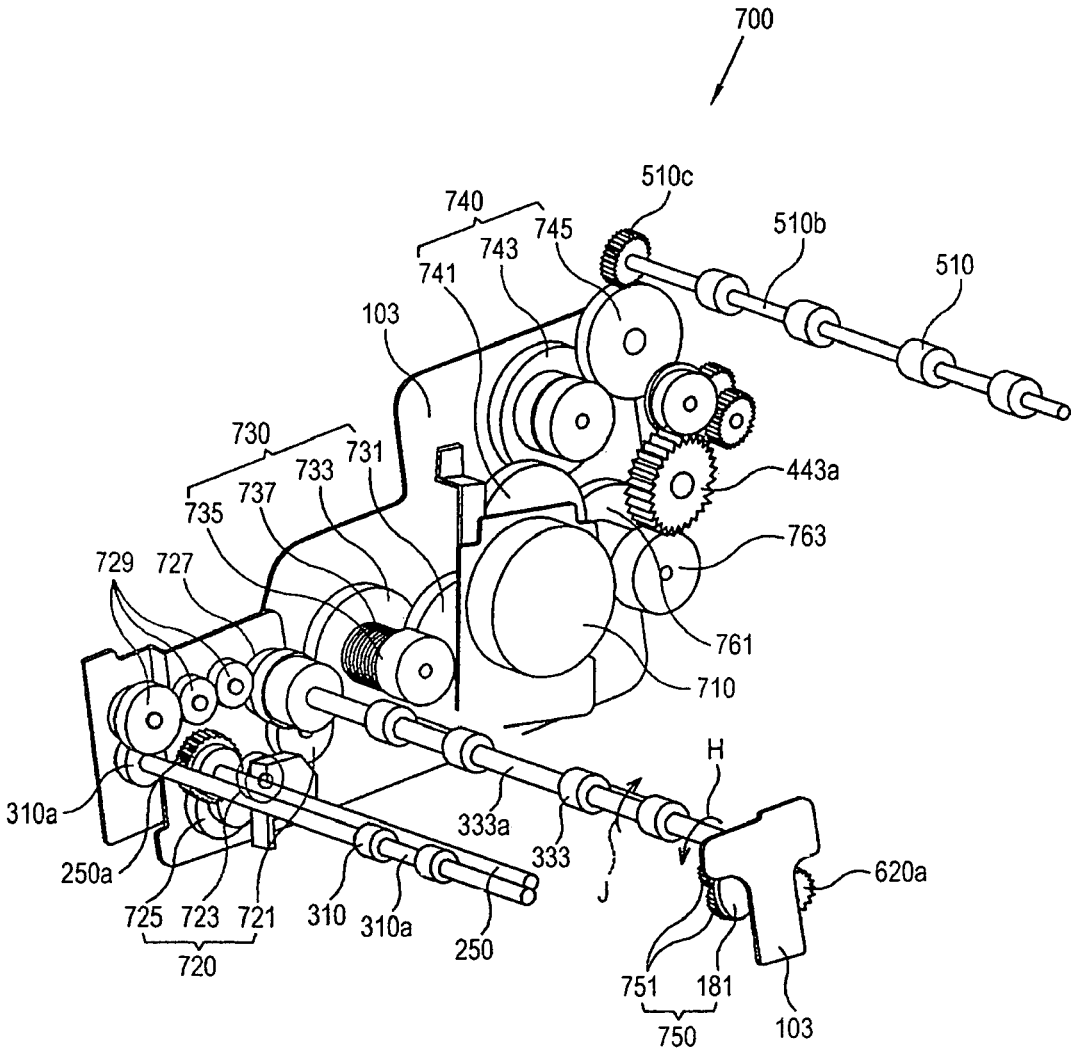
FIG. 5 is a schematic perspective view of a power transmission unit according to an embodiment of the present invention.

FIG. 3 is a schematic view of an image forming apparatus 100 capable of practicing an embodiment of the present invention. FIG. 4 is a schematic perspective view of a duplex carrying unit 600 according to an embodiment of the present invention. FIG. 5 is a schematic perspective view of a power transmission unit 700 according to an embodiment of the present invention.

As shown therein, the image forming apparatus 100 according to an embodiment of the present invention includes a medium feeding unit 200 to supply a print medium; a carrying unit 300 to carry the print medium; an image forming unit 400 to form an image on the print medium; a medium ejecting unit 500 to eject the print medium, on which an image is formed by the image forming unit 400, out of the image forming apparatus 200; a duplex carrying unit 600 to return the print medium, printing on the first side of which being completed, back to the image forming unit 400 for printing the second side of the print medium; and a power transmission unit 700 to transmit driving power from a driving power source 710 to one or more of the above described elements.

According to an embodiment of the present invention, the image forming apparatus 100 may have a single-side printing path SP along which a print medium travels to undergoes printing on first-side thereof, and a duplex printing path DP along which the printing medium that had passed through the single-side printing path SP may be returned to the image forming unit 400.

The medium feeding unit 200 includes a feeding cassette 210, a knock-up plate 230, accommodated in the feeding cassette 210, for knocking up the print medium, a friction pad 270, which may prevent more than one sheet of the print medium stacked on the knock-up plate 230 being carried at a time, and a pick-up roller 250 picking up and moving the print medium toward the carrying unit 300. Typically, some or all of the components of the medium feeding unit 200 may be detachably provided in the main body 101 of the image forming apparatus 100.

The carrying unit 300 includes a carrying roller 310 to carry the print medium picked up by the pick-up roller 250, and an aligning roller 330 to align the edge of the print medium carried by the carrying roller 310, and to supply the print medium to the image forming unit 400. The aligning roller 330 may include a pair of rollers 331 and 333, one of which, e.g., the roller 331 may drive the other roller, e.g., the roller 333.

The image forming unit 400 forms an image on the print medium fed by the carrying unit 300. According to an embodiment, the image forming unit 400 may include a developing unit 410, which may apply, e.g., developer on the print medium, a light scanning unit 420 to form a latent image on the photosensitive body 411 of the developing unit 410, a transferring unit 430 to transfer the developer from the photosensitive body 411 to the print medium, and a fusing unit 440 to fuse the developer on the print medium.

The developing unit 410 may be detachably provided in the main body 101 of the image forming apparatus 100. The developing unit 410 applies the developer stored therein to the print medium to thereby form an image. When the developer is used up, the developing unit 410 may be replaced. The developing unit 410 may include the photosensitive body 411 to which the developer is applied, a developing roller 413 to apply the developer to the latent image on the photosensitive body 411, a developer storage 415 in which the developer is stored, and a photosensitive body driving gear 411*a* (shown in FIGS. 6 and 7), which is provided on one side of the photosensitive body 411, and which drives the photosensitive body 411 with the driving power from a developing unit driver 730. The other components of the developing unit 410 as well as the developing roller 413 may be driven in synchronous relation with the photosensitive body driving gear 411*a*.

The light scanning unit 420 emits light on the surface of the photosensitive body 411 to form a latent image corresponding to image data. The transferring unit 430 may apply a bias voltage, which has electric polarity opposite to that of the developer, to the back side of the print medium, thereby transferring the developer from the surface of the photosensitive body 411 to the print medium. The fusing unit 440 may apply heat and/or pressure to the print medium, thereby fixing the developer on the print medium. To this end, the fusing unit 440 may include a heating roller 443 to heat the print medium, and a pressing roller 441 that may form a nip together with the heating roller 443 to press the print medium.

The medium ejecting unit 500 ejects the print medium that has been passed through the image forming unit 400 to the outside of the main body 101. Further, the medium ejecting unit 500 may also carry the print medium, the printing one side of which has been completed, to the duplex carrying unit 600 for duplex printing. For this, the medium ejecting unit 500 may rotate in both forward and backward directions.

The medium ejecting unit 500 may include an ejecting roller 510 capable of rotating in both forward and backward directions by the driving power source 710, and one or more idle rollers 530 opposing the ejecting roller 510 to passively rotate therewith.

The duplex carrying unit 600 may return the print medium, one side of which has been applied with the developer from the image forming unit 400, and which has an image thereon, back to the image forming unit 400 for printing the other side of the print medium. As shown in FIGS. 3 and 4, the duplex carrying unit 600 may include a first duplex roller 610, a second duplex roller 620 and a duplex supporting frame 630 rotatably supporting the first and second duplex rollers 610 and 620. The first duplex roller 610 may be provided in plural as shown in FIGS. 3 and 4 or may be provided as a single roller depending on, e.g., the length and the shape of the duplex carrying path.

The duplex supporting frame 630 rotatably supports the first and second duplex rollers 610 and 620, and guides the print medium. The duplex supporting frame 630 may be detachably provided in the main body 101 of the image forming apparatus 100. The duplex supporting frame 630 may be mounted to, and separated from, the main body 101 while being guided by the sliding guide N (shown FIG. 3), which may be provided in the main body 101, and which may have ".OR right." shape. When the duplex supporting frame 630 is mounted to and separated from the main body 101, a duplex gear 620*a* (further described below) may engage with, and released from, a reduction gear(s) 729.

Figure 9:
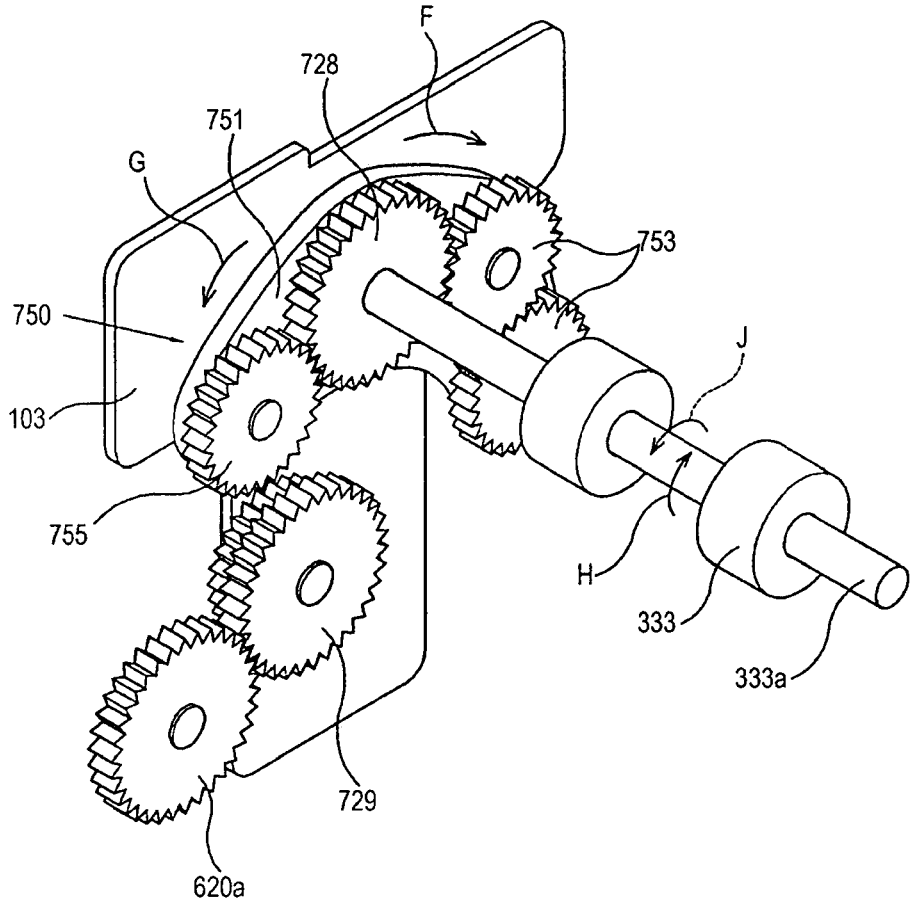
FIGS. 9 through 11B illustrate a swing gear unit of FIG. 5.

The shaft 620*c* for the second duplex roller 620 may have a first end part, at which a duplex gear 620*a* may be supported, and a second end part, at which a second pulley 620*b* may be supported. As shown in FIG. 9, the driving power source 710 transmits rotational drive power to the duplex gear 620*a* via a swing gear unit 750, so as to cause the duplex gear 620*a* to rotate.

This rotation may be transmitted to the first duplex roller 610 via the second pulley 620*b*, the belt 631 and the first pulley 610*a*, which may be supported to rotate coaxially with the first duplex roller 610. While only one first duplex roller 610 is shown for brevity, any number of first duplex rollers. According to an embodiment, the power transmission between the first and second duplex rollers 610 and 620 may be achieved by other mechanism than the belt 631 that allows the first and the second duplex rollers 610 and 620 to rotate in the same direction.

Further, the duplex carrying unit 600 may include a print medium supporting plate 640, an aligning guide 650 and a print medium oblique member 660.

The print medium supporting plate 640 may extend from the aligning guide 650 to parallel to the duplex supporting frame 630 to form a print medium passage B together therewith.

The aligning guide 650 may be coupled to the duplex supporting frame 630 to align the print medium P received from the medium ejecting unit 500.

The print medium oblique member 660 may be rotatably installed in the print medium supporting plate 640 on a shaft non-parallel to the shaft supporting the first duplex roller 610. Thus, the print medium P being received from the medium ejecting unit 500 moves obliquely toward the aligning guide 650 through the print medium oblique member 660 while a lateral edge of the print medium P runs against the wall of the aligning guide 650, so that the print medium P can be aligned.

The power transmission unit 700 may transmit the driving power from the driving power source 710 to various elements. For example, as shown in FIG. 5, the power transmission unit 700 may include the driving power source 710, a carrying unit driver 720 to transmit the driving power from the driving power source 710 to the carrying unit 300, a developing unit driver 730 to transmit the driving power to the developing unit 410, an ejecting unit driver 740 to transmit the driving power to the medium ejecting unit 500, and the swing gear unit 750 to drive the duplex carrying unit 600.

The driving power source 710 may be provided as, e.g., a single motor mounted in the main body 101.

The carrying unit driver 720 may transmit the driving power from the driving power source 710 to the pick-up roller 250 and the carrying unit 300. The carrying unit driver 720 may include a first pick-up roller gear 721, a second pick-up roller gear 723, and a third pick-up roller gear 725 to drive the pick-up roller 250 in a controlled manner according to, e.g., control signals from a controller (not shown). While the three pick-up rollers shown in FIG. 5 as an example, the number of pick-up roller gears is not limited, and may be changed in consideration of the gear ratio and/or the distance between the driving power source 710 and the pick-up roller 250.

According to an embodiment, the carrying unit driver 720 may further include an electronic clutch 727 to selectively transmit the driving power from the driving power source 710 to the aligning roller 331. Thus, the aligning roller 331 may be made either to rotate or to remain idle according to the electronic clutch 727 provided on the aligning roller shaft 331*a*.

The carrying unit driver 720 may include a plurality of carrying roller driving gears 729 to transmit the driving power to the carrying roller 310.

Figure 6:
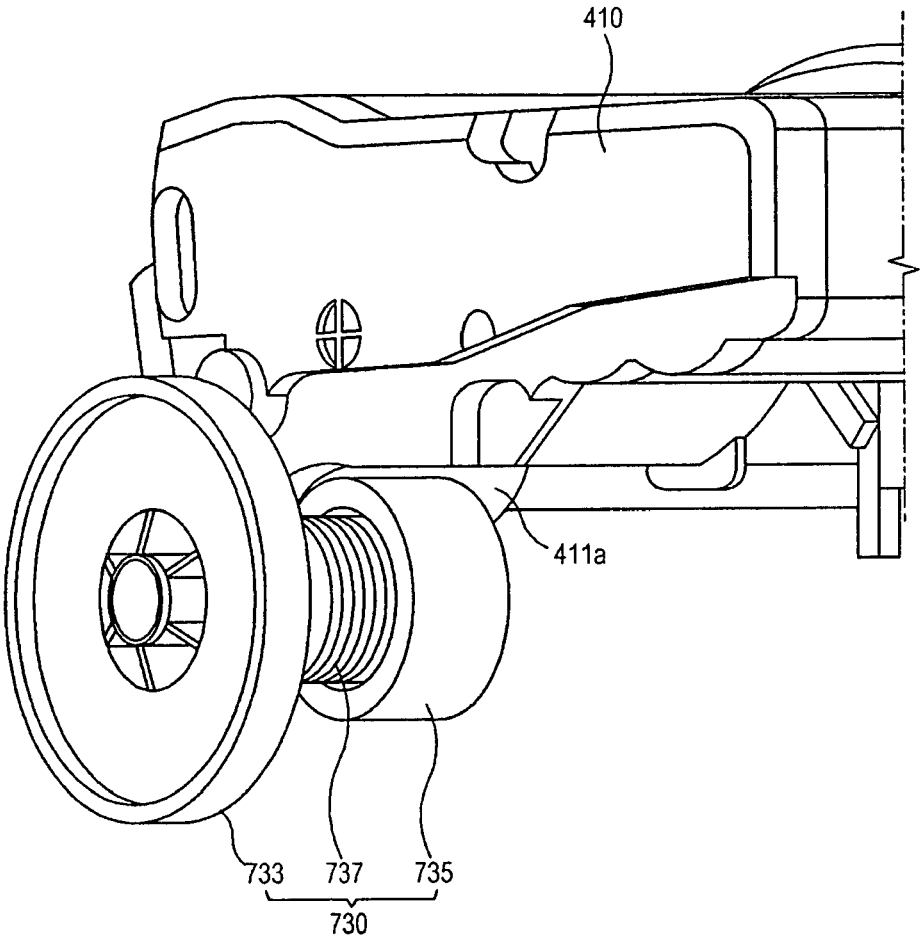
FIGS. 6 through 8B illustrate a developing unit driver of FIG. 5.
Figure 7:
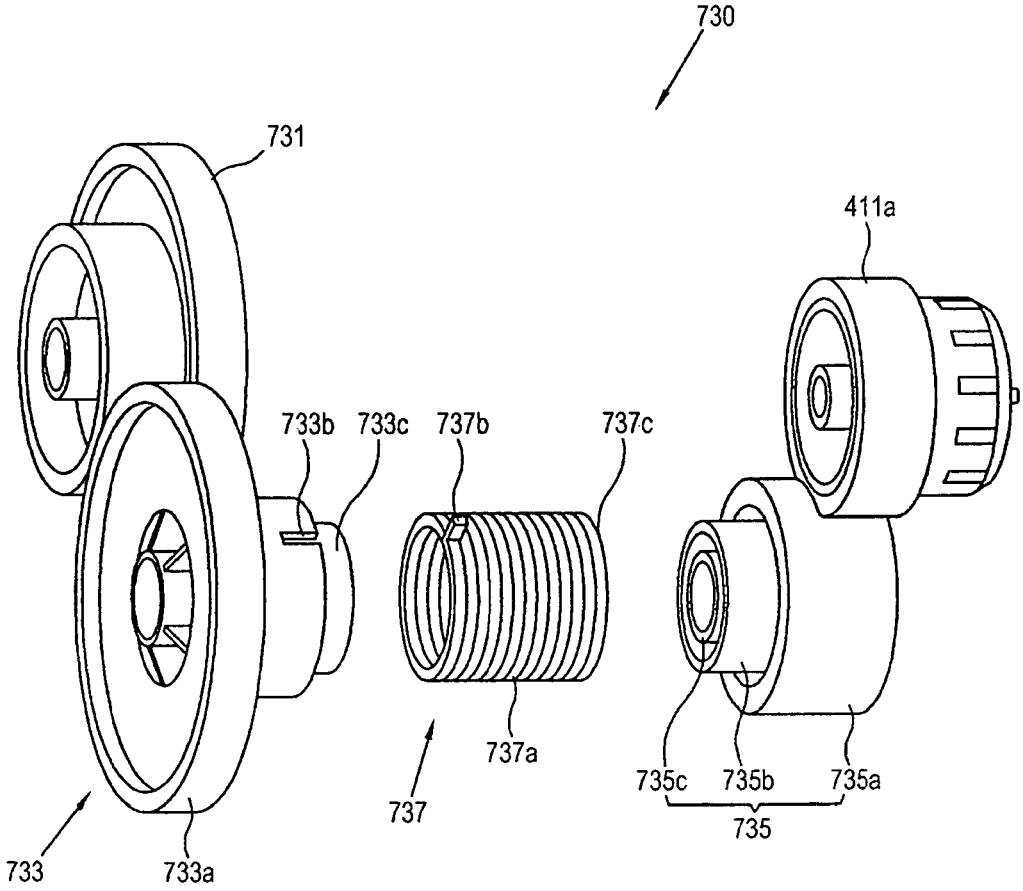

The developing unit driver 730 may transmit the driving power from the driving power source 710 to the developing unit 410. Referring to FIGS. 5 through 7, the developing unit driver 730 may include a first developing unit gear 731 to receive the driving power from the driving power source 710, a second developing unit gear 733 engaged with the first developing unit gear 731 to receive the driving power therefrom, a developing unit passive gear 735 to transmit the driving power from the second developing unit gear 733 to the photosensitive body gear 411*a*, and an elastic clutch 737 provided between the second developing unit gear 733 and the developing unit passive gear 735 to selectively transmit the driving power so that the photosensitive body 411 may rotate in one direction.

As shown in FIG. 7, the second developing unit gear 733 may includes a second developing unit gear main body 733*a* rotatable by the driving power delivered by the first developing unit gear 731, a clutch coupling part 733*b* to which one end of the elastic clutch 737 is coupled, and a transmission shaft 733*c* to transmit rotation of the second developing unit gear main body 733*a* to the elastic clutch 737.

The second developing unit gear main body 733*a* rotates and transmits the rotation of the driving power source 710 to the elastic clutch 737. According to an embodiment, the second developing unit gear main body 733*a* has a toothed outer circumference, the engagement of which is used to transmit the driving power. However, the second developing unit gear main body 733*a* may alternatively or additionally employ a driving belt, a friction pad, or the like.

The clutch coupling part 733*b* is coupled to a coupling member 737*b* of the elastic clutch 737. In this embodiment, the clutch coupling part 733*b* is achieved by a fitting groove to which the coupling member 737*b* is fitted. Alternatively, for example, the clutch coupling part 733*b* may have various shapes such as a hook, a projection rib, or the like, that corresponds to the shape of the coupling member 737*b*.

According to the embodiment, the developing unit passive gear 735 transmits the driving power from the driving power source 710 to the developing unit 410 through the elastic clutch 737. The developing unit passive gear 735 includes a developing unit passive gear main body 735*a* engaged with the photosensitive body driving gear 411*a* for transmitting the driving power, and a coupling shaft 735*b* coupled with the elastic clutch 737. The developing unit passive gear main body 735*a* is provided with structure(s) corresponding to the photosensitive body driving gear 411*a* to transmits the driving power thereto. In the present embodiment, teeth provided in each of the developing unit passive gear main body 735*a* and the photosensitive body driving gear 411*a* are engaged with each other to transmit the rotational power.

The coupling shaft 735*b* is accommodated inside of the second end part 737*c* of the elastic clutch 737. At this time, the coupling shaft 733*c* is pressingly fitted to the inner surface of the second end part 737*c* of the elastic clutch 737 (refer to FIGS. 8A and 8B). To this end, an outer diameter of the coupling shaft 735*b* is equal to or larger than the inner diameter of the second end part 737*c*.

The elastic clutch 737 is provided between the second developing unit gear 733 and the developing unit passive gear 735 and controls the driving power, so that the second developing unit gear 733 can be made to rotate in the forward and backward directions so as to allow the carrying unit driver 720 and the swing gear unit 750 to rotate in the forward and reverse directions while the developing unit passive gear 735 is made to rotate in a single direction so as to make the developing unit 410 to rotate only in the forward direction. Referring to FIG. 7, the elastic clutch 737 includes a clutch main body 737*a* shaped as a coil spring, and the coupling member 737*b* provided in the first end part of the clutch main body 737*a*.

When a driving direction of the photosensitive body driving gear 411*a* is in the forward direction, the coil of the clutch main body 737*a* may be wound in the forward direction. The first end part of the clutch main body 737*a* is provided with the coupling member 737*b* so as to be coupled to the clutch coupling part 733*b* of the second developing unit gear 733. As shown, the coupling member 737*b* protrudes along an outer circumference of the clutch main body 737*a* and is accommodated in the clutch coupling part 733*b*. The second end part 737*c* of the clutch main body 737*a* may be elastically fitted to the developing unit passive gear 735. For this, the second end part 737*c* may be made smaller than or equal to the outer diameter R1 of the coupling shaft 735*b*.

Figure 8A:
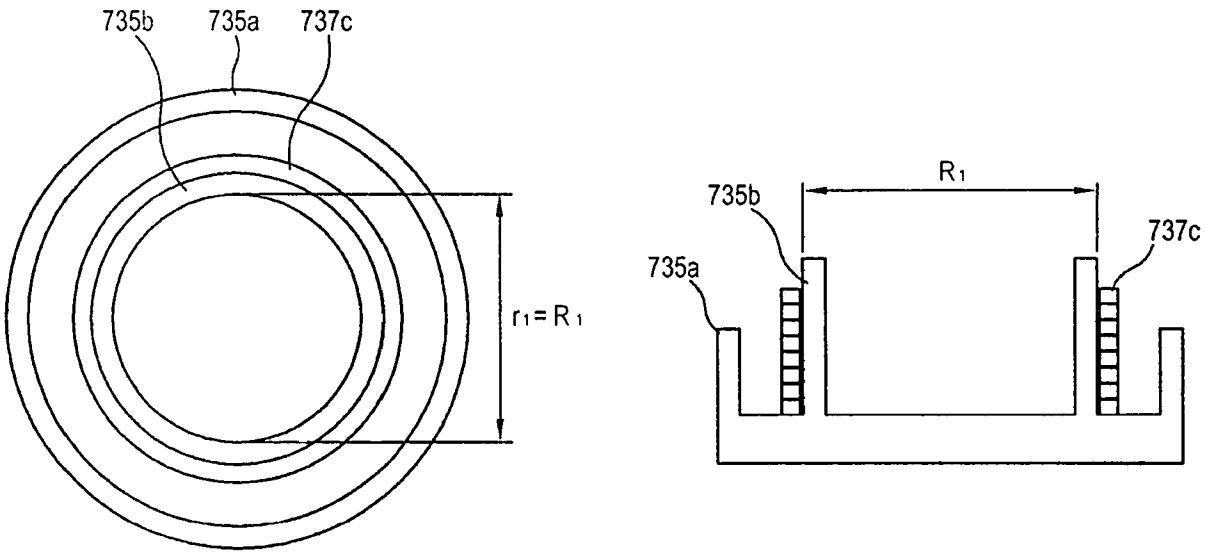

The clutch main body 737*a* has the second end part 737*c* coupled to the coupling shaft 735*b*, the inner diameter of the clutch main body 737*a* may be changeable according to the rotational direction of the second developing unit gear 733, thereby controlling the power transmission to the developing unit passive gear 735. For example, when the second developing unit gear 733 rotates in the forward direction, i.e., a direction of winding the coil, the inner diameter r1 of the clutch main body 737*a* decreases (r1=R1). Thus, since a coupling force between the second end part 737*c* and the coupling shaft 735*b* increases as shown in FIG. 8A, the developing unit passive gear 735 rotates along with the clutch main body 737*a* in the forward direction. Accordingly, the driving power is transmitted to the photosensitive body driving gear 411*a* coupled with the developing unit passive gear 735, and the developing unit 410 applies the developer to the print medium, thereby forming an image.

On the other hand, in the case that a user wants the duplex printing and thus the medium ejecting unit 500 and the duplex carrying unit 600 have to be driven in reverse to convey the print medium in the returning direction (e.g., the DP direction shown in FIG. 3), the driving power source 710 rotates in the direction opposite to the driving direction of the developing unit 410. Thus, the second developing unit gear 733 rotates in the backward direction, so that the clutch main body 737*a* rotates in a direction of unwinding the coil resulting in the inner diameter of the clutch main body 737*a* to increase to, e.g., r2.

Figure 8B:
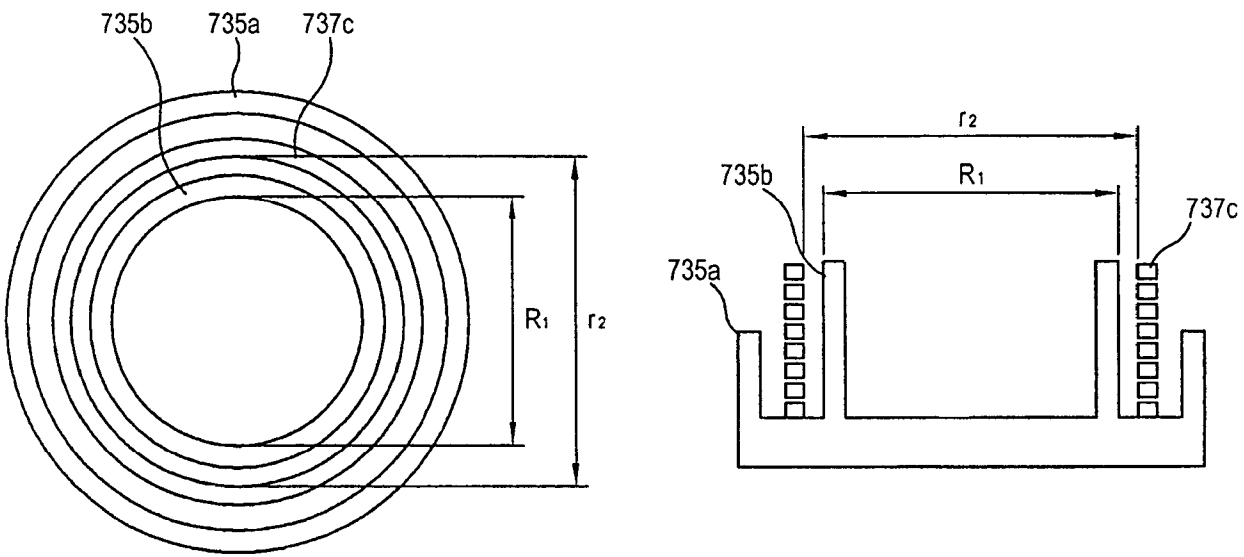

Referring to FIG. 8B, the inner diameter r2 of the clutch main body 737*a* increases to become larger than the coupling shaft 735*b*, so that clearance can be formed between the second end part 737*c* of the clutch main body 737*a* and the coupling shaft 735*b*, thereby preventing the rotation of the clutch main body 737*a* from being transmitted to the coupling shaft 735*b*. Thus, when the second developing unit gear 733 rotates in the backward direction, the inner diameter of the elastic clutch 737 changes (r2>R1), and thus the driving power is not transmitted to the developing unit passive gear 735. In this case, since the second developing unit gear 733 rotates in the backward direction, the ejecting unit driver 740, the electronic clutch 727 and the swing gear unit 750 are rotated in the backward direction, thereby carrying the print medium in the returning direction, e.g., DP shown in FIG. 3.

While the second developing unit gear 733 rotates in the forward direction, the clutch main body 737*a* adjusts the diameter difference between the second end part 737*c* and the coupling shaft 735*b* so as to transmit the driving power to the developing unit passive gear 735. Accordingly, it is possible to reduce the shock, which may be caused by the conventional engagement between the gears. Also, the above coil spring clutch embodiment may make it possible to further reduce the shock and/or noise.

As shown in FIGS. 5 and 9, the swing gear unit 750 includes a swing member 751 moveably coupled to frame 103, a first swing gear 753 and a second swing gear 755.

The swing member 751 is coupled to the frame 103 so as to swing between the first direction F and the second direction G about the aligning roller shaft 333*a* that supports the aligning roller 333. The aligning roller shaft 333*a* has one end coupled to the swing driving gear 728, and the other end coupled to the electronic clutch 727.

The aligning roller shaft 333*a* rotatably supports the swing member 751, so that the swing driving gear 728 and the aligning roller shaft 121*a* can rotate in a forward direction H and a backward direction J. Accordingly, the friction between the swing member 751 and the aligning roller shaft 333*a* causes the swing member 751 to swing between the first direction F and the second direction G.

The first swing gear 753 is provided on one side of the swing member 751, and engaged with the reduction gear 729 as the swing member 751 swings in the first direction F. The reduction gear 729 includes a first gear 729*a* and a second gear 729*b*, which are coaxially provided to rotate together (refer to FIG. 10A).

In this embodiment, the reduction gear 729 is used for changing the revolution per minute (RPM) in consideration of a rotational speed difference between the aligning roller 333 and the second duplex roller 620. The reduction gear 729 engages with the duplex gear 620*a*.

The second swing gear 755 is placed in the side of the swing member 751 opposite to the side of the first swing gear 753, and engages with the reduction gear 729 as the swing member 751 swings in the second direction G, thereby transmitting the driving power to the duplex gear 620*a*. In the present embodiment, in order to transmit a rotational power in one direction to the duplex gear 620*a* regardless of the rotational direction of the aligning roller shaft 333*a*, there may be provided different numbers of first swing gear 753 and the second swing gear 755, e.g., an even number of first swing gear 753 and an odd number of second swing gear 755.

While in the above example, the swing driving gear 728 is shown to be supported by the aligning roller shaft 333*a*, the scope of the application of the present invention is not be so limited to only such configuration. For example, alternatively, the swing driving gear 728 may be connected to a carrying roller shaft. In that case, there may be provided a power transmission delivery mechanism such as, e.g., a gear train or a belt to transmit the driving power to the duplex gear 620*a*. Thus, it is preferable but not indispensable that the swig driving gear 728 is installed in the aligning roller shaft 333*a*. As another alternative example, the swing driving gear 728 may be, instead of being supported by the aligning roller shaft 333*a*, provided to rotate about a stud provided in the frame 103 parallel to the aligning roller shaft 333*a*.

Below, the power transmission between the elements of the image forming apparatus 100 with the foregoing configuration according to an embodiment of the present invention will be described with reference to FIGS. 3 through 11B.

First, the rotation of the driving power source 710 is transmitted to the carrying roller 310 via a pinion (not shown and hereinafter referred to as a 'driving pinion') installed in a driving shaft (not shown) of the driving power source 710, the first developing unit gear 731, the second developing unit gear 733, the gear of the electronic clutch 727, the first and third pick-up roller gears 721 and 725, and the carrying roller gear 310*a* in a predetermined sequence.

The pick-up roller 250 receives the rotational power through the gear of the electronic clutch 727, the first and second pick-up roller gear 721 and 723, and a pick-up roller gear 250*a*. The rotation to be transmitted to the pick-up roller 250 may be controlled by, for example, a solenoid (not shown).

Further, the rotation to be transmitted from the driving power source 710 to the aligning roller 333 may be controlled by the electronic clutch 727 provided in the aligning roller shaft 333*a*.

The heating roller 443 receives the driving power via the driving pinion, a transmission gear 743, a gear 761, a gear 763, and a heating roller gear 443*a*. The heating roller gear 443*a* is supported by a rotational shaft of the heating roller 443, and is driven to rotate as the heating roller 443 opposes the pressing roller 441. The gears 761 and 763 may be provided coaxially with respect to each other, and the driving power may be transmitted from the gear 761 to the gear 763 only when the driving pinion of the driving power source 710 rotates in the forward direction. On the other hand, when the driving pinion rotates in the backward direction, the power transmission is not allowed between the gears 761 and 763. To this end, for example, a one-directional clutch such as a spring clutch or a hub clutch may be used between the gears 761 and 763.

The duplex carrying unit 600 (e.g., the second duplex roller 620) receives the rotational power from the driving power source 710 through the swing gear unit 750.

Figure 10A:
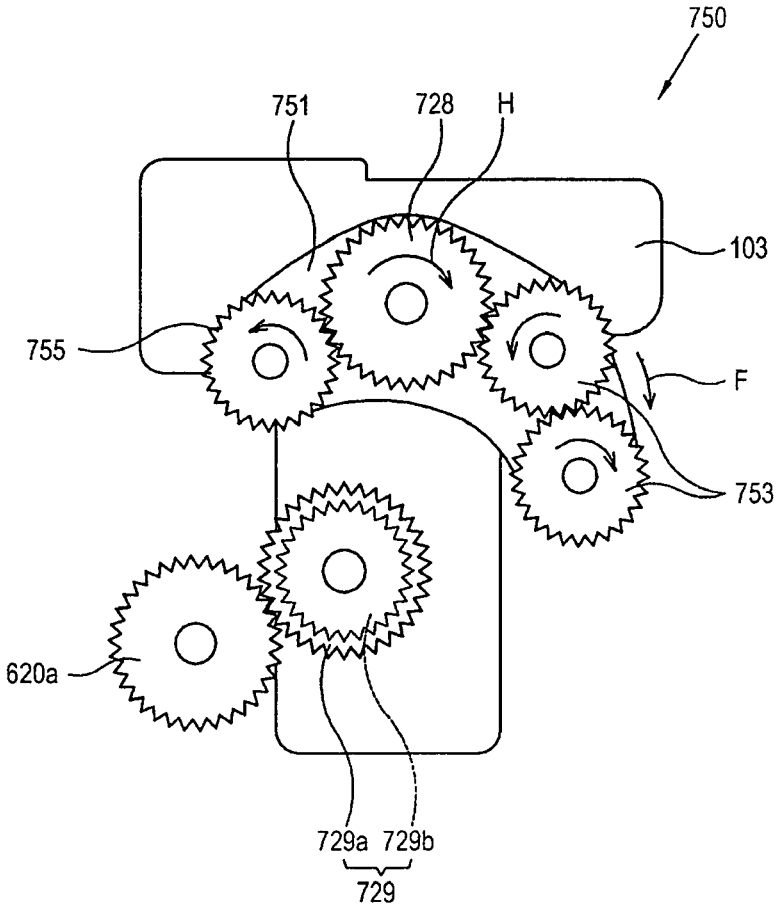
Figure 10B:
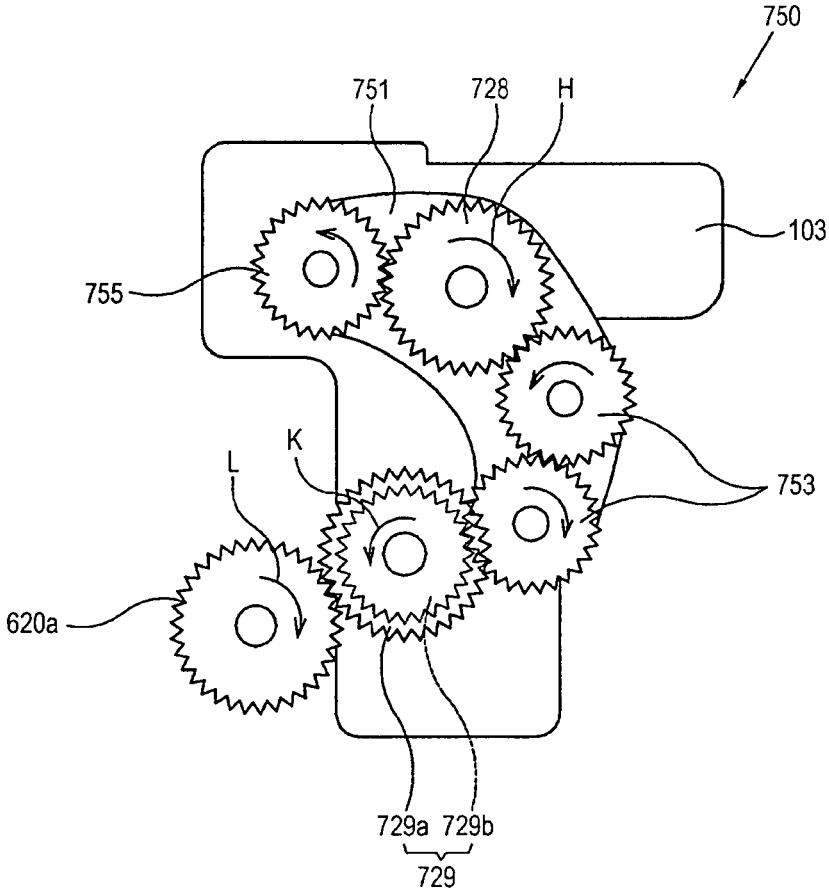

As shown in FIG. 10A, the swing driving gear 728 rotates in the forward direction H, resulting in the first and second swing gear(s) 753 and 755 that are engaged with the swing driving gear 728 also rotating. The swing member 751 swings in the first direction F as shown in FIG. 10B, and the first swing gear(s) 753 rotates the reduction gear 729 in a backward direction K while being engaged with the second gear 729*b* of the reduction gear 729, thereby rotating the duplex gear 620*a* in a forward direction L.

Figure 11A:
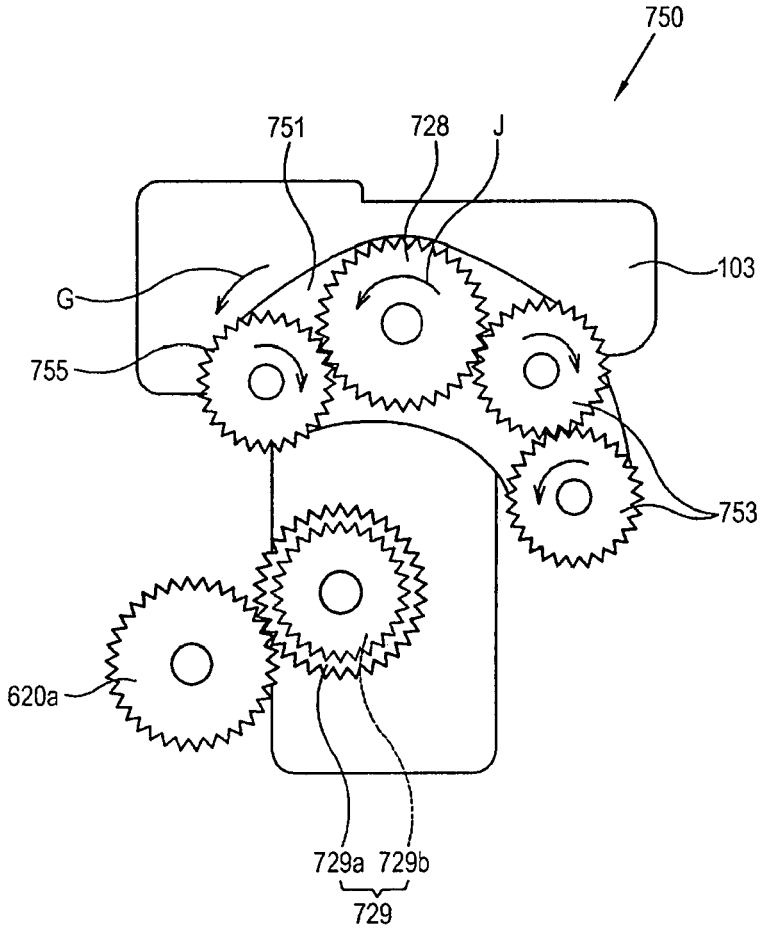
Figure 11B:
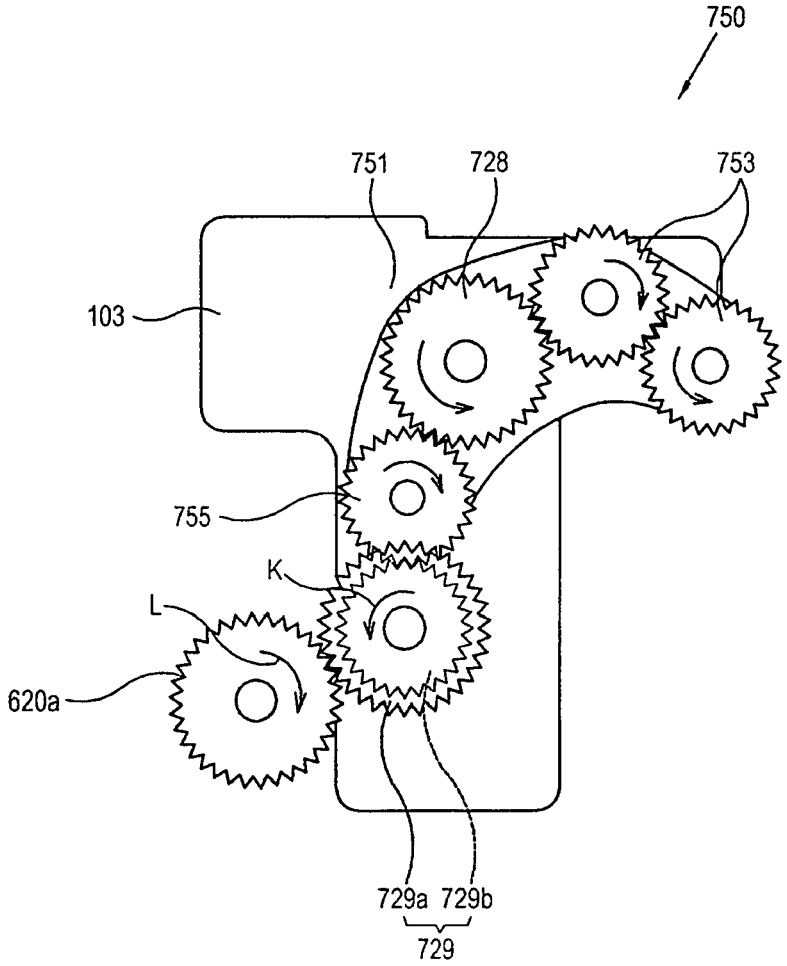

On the other hand, if the swing driving gear 728 rotates in the backward direction J, the first and second swing gears 753 and 755 are rotated in the reverse direction to the direction shown in FIG. 11A. Thus, the swing member 751 swings in the second direction G as shown in FIG. 11B, the second swing gear 755 rotates the reduction gear 729 in the same backward direction K as shown in FIG. 10B while being engaged with the second gear 729*b* of the reduction gear 729, thereby rotating the duplex gear 620*a* in a forward direction L as shown in FIG. 10B. In other words, the duplex gear 620*a* rotates in the same direction regardless of the direction of rotation of the swing driving gear 728. Accordingly, the duplex carrying unit 600 is driven to rotate in the direction L to carry the print medium toward the aligning roller 333 regardless of whether the driving power source 710 rotates in the forward or backward.

An example of a single-side printing operation of the image forming apparatus 100 with the configuration of embodiments will be described with reference to FIG. 3.

The controller (not shown) rotates the driving power source 710 in the forward direction and controls the solenoid (not shown) to transmit the driving power to the pick-up roller 250. Then, the pick-up roller 250 picks up the print medium, which is carried by the carrying roller 310 toward the aligning rollers 330.

The controller (not shown) turns off the electronic clutch 727 and thus controls the aligning roller 330 to idle, thereby making the end part of the print medium to run against the aligning roller 330. Then, after a lapse of predetermined time, the controller turns on the electronic clutch 727 to thereby carry the print medium toward the image forming unit 400. Then, the image forming unit 400 develops an image on the carried print medium with the developer.

The developer is fixed on the print medium while the print medium passes through the heating roller 443 and the pressing roller 441. The print medium, one side of which has an image based on the fixed developer, is ejected to the outside by the medium ejecting unit 500.

In the case of duplex printing, the controller (not shown) controls the driving power source 710 to rotate in the backward direction and rotates the medium ejecting unit 500 holding the print medium, one side of which has a printed image, in the backward direction. Thus, the print medium is carried toward the duplex carrying unit 600. In consideration of reducing electric power consumption, it is preferable but not indispensable that the electronic clutch 727 is turned off until the print medium enters the first duplex roller 610.

According to an embodiment, the controller (not shown) may turn on the electronic clutch 727 when the print medium enters the second duplex roller 620, and may allow the driving power to be transmitted to the first and second duplex rollers 610 and 620 via the aligning roller shaft 333*a* and the swing gear unit 750 as previously described. Thus, the first duplex roller 610 rotates in the direction L and moves the print medium from the medium ejecting roller 510 towards the aligning roller 333.

The print medium, of which the leading and trailing edges are still held by the first duplex roller 610 and the medium ejecting roller 510, respectively, is moved further along in the L direction by the first duplex roller 610 to separate from the ejecting roller 510, and to move toward the second duplex roller 620.

Before the aligning roller 333 receives the print medium, the print medium is carried toward the aligning roller 333 regardless of whether the driving power source 710 rotates in the forward direction or the backward direction. However, the controller controls the driving power source 710 to rotate in the forward direction before the leading edge of the print medium enters the aligning roller 333.

Although the driving power source 710 is changed to rotate in the forward direction, yet the second duplex roller 620 still rotates in the direction L by the operation of the swing gear unit 750. Therefore, the print medium moves past the image forming unit 400. After the trailing edge of the print medium has passed through the aligning unit 333, the electronic clutch 727 may be turned off.

While passing through the image forming unit 400, an image is formed on the print medium with the driving power source 710 in the forward rotation, so that the ejecting roller 510 rotates in the forward direction, thereby ejecting the print medium outward. Accordingly, the duplex printing is completed.

According to an embodiment of the present invention, a single driving power source 710, the elastic clutch 737, and the swing gear unit 750 are employed in driving the internal rotatable elements of the image forming apparatus 100, thereby reducing manufacturing cost of the image forming apparatus.

Figure 2:
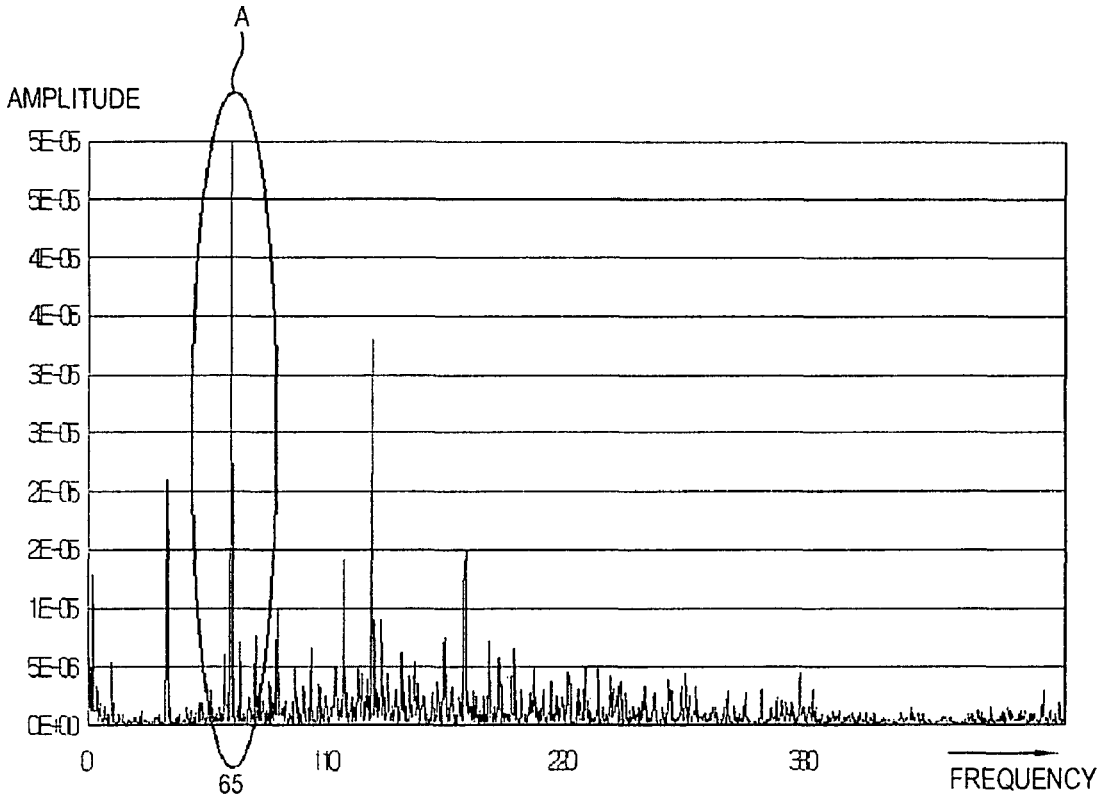
FIG. 2 is a graph showing jitter generation in the conventional hub clutch.
Figure 12:
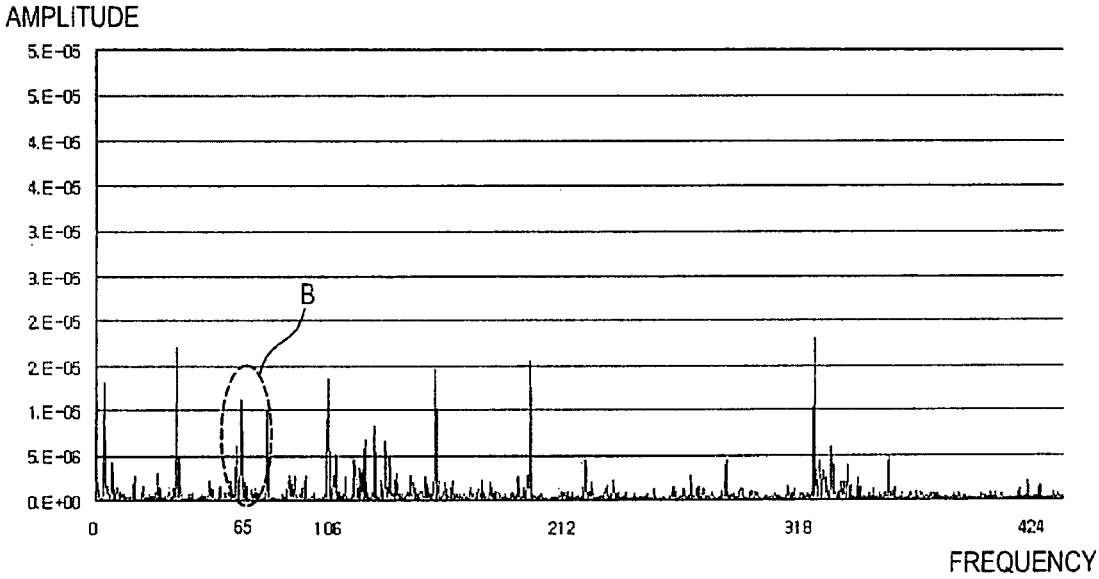
FIG. 12 is a graph showing jitter generation of the image forming apparatus according to an embodiment of the present invention.

Further, in the image forming apparatus 100 according to an embodiment of the present invention, an area B of a jitter generated by the elastic clutch 737 is decreased in amplitude (as shown in FIG. 12) as compared with the jitter area A of the conventional developing unit shown in FIG. 2. That is, the elastic clutch 737 may reduce the vibration and/or the noise of the image forming apparatus.

As described above, a power transmission apparatus for an image forming apparatus according to an embodiment of the present invention employs an elastic clutch to reduce the vibration and/or shock generated when a driving unit and a driven unit are rotated, thereby decreasing jitter generation.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A power transmission apparatus for transmitting driving power from a driving power source to at least first and second movable members of an image forming apparatus, the driving power being a bi-directional rotational power in first and second directions of rotation, the power transmission apparatus comprising:

a driving unit configured to receive the driving power transmitted from the driving power source and to convey the driving power to the first movable member so as to cause the first movable member to rotate in the first and second directions;

a driven unit coupled to the second movable member; and an elastic clutch including a coil spring which is wound in a direction of driving the second movable member in the first direction and provided between the driving unit and the driven unit, wherein the second movable member comprises a photosensitive body.

2. The power transmission apparatus according to claim 1, wherein the coil spring comprises a first end thereof coupled to one of the driving unit and the driven unit and a second end press fitted to the other one of the driving unit and the driven unit.

3. The power transmission apparatus according to claim 2, wherein the second end of the coil spring having a spring diameter that, when the driving power is in the first direction, decreases to a first size equal to or smaller than a diameter of the one of the driving unit and the driven unit to which the second end is coupled so as to remain press fitted thereto, the spring diameter increasing when the driving power is in the second direction to a second size larger than the diameter of the one of the driving unit and the driven unit so as to release the one of the driving unit and the driven unit from the second end of the coil spring.

4. The power transmission apparatus according to claim 3, wherein:

the first movable member comprises an ejection roller configured to rotate in the first direction to eject printing medium, which has been processed, out of the image forming apparatus, the ejection roller being configured to rotate in the second direction to direct the printing medium towards a duplex printing medium path.

5. The power transmission apparatus according to claim 1, wherein the elastic clutch is configured to selectively couple the driving unit and the driven unit to allow the driven unit to receive the driving power from the driving unit, and to transmit the driving power to the second movable member to cause the second movable member to rotate in the first direction when the driving power is in the first direction, the elastic clutch being further configured to decouple the driving unit and the driven unit when the driving power is in the second direction so that the driving power in the second direction is not transmitted to the second movable member.

6. A power transmission apparatus for transmitting driving power from a driving power source to at least first and second movable members of an image forming apparatus, the driving power being a bi-directional rotational power in first and second directions of rotation, the power transmission apparatus comprising:

a driving unit configured to receive the driving power transmitted from the driving power source and to convey the driving power to the first movable member so as to cause the first movable member to rotate in the first and second directions;

a driven unit coupled to the second movable member;

an elastic clutch including a coil spring which is wound in a direction of driving the second movable member in the first direction and provided between the driving unit and the driven unit;

a driven gear coupled to a third movable member; and a swing gear unit having a gear train supported on a swing gear unit frame, the gear train including a center gear configured to receive the driving power from the driving power source, a first number of first side gears on a first side of the center gear and a second number of second side gears on a second side opposite to the first side, the first number being different from the second number, the frame being configured rotate about an axis such that when the driving power is in the first direction the frame rotates to allow one of the first side gears to engage the driven gear to cause the third movable member to rotate in the first direction, the frame being further configured rotate about the axis such that when the driving power is in the second direction the frame rotates to allow one of the second side gears to engage the driven gear to cause the third movable member to rotate in the first direction.

7. The power transmission apparatus according to claim 6, wherein:

the third movable member, comprises a duplex roller disposed in a duplex path, in which path a printing medium having one of its two printing surfaces processed travels to have the other one of the two printing surfaces processed.

8. The power transmission apparatus according to claim 6, wherein:

the first number is an odd number, and wherein the second number is an even number.

9. The power transmission apparatus according to claim 6, further comprising:

an alignment roller shaft supporting alignment rollers configured to align a printing medium prior to forming an image on the printing medium, wherein the center gear is coupled to, and rotates with, the alignment roller shaft.

10. An image forming apparatus comprising:

a developing unit which forms an image on a print medium;

a duplex carrying unit which returns the print medium, one side of which has a formed image, to the developing unit;

a driving power source configured to produce a driving power, the driving power being a bi-directional rotational power in first and second directions of rotation;

an ejection roller configured to rotate in the first direction to eject the printing medium, which has been processed, out of the image forming apparatus, the ejection roller being configured to rotate in the second direction to direct the printing medium towards the duplex carrying unit;

a bi-directional power conveyance mechanism disposed between the driving power source and the ejection roller, the bi-directional power conveyance mechanism being configured to convey the driving power from the driving power source to the ejection roller so as to cause the ejection roller to rotate in the first direction and in the second direction;

a driving unit configured to receive the driving power from the driving power source;

a driven unit coupled to a movable member of the developing unit; and an elastic clutch including a coil spring which is wound in a direction of driving the movable member of the developing unit in the first direction and provided between the driving unit and the driven unit.

11. The image forming apparatus according to claim 10, wherein:

the coil spring comprises a first end thereof coupled to one of the driving unit and the driven unit and a second end press fitted to the other one of the driving unit and the driven unit.

12. The image forming apparatus according to claim 11, wherein:

the second end of the coil spring having a spring diameter that, when the driving power is in the first direction, decreases to a first size equal to or smaller than a diameter of the one of the driving unit and the driven unit to which the second end is coupled so as to remain press fitted thereto, the spring diameter increasing when the driving power is in the second direction to a second size larger than the diameter of the one of the driving unit and the driven unit so as to release the one of the driving unit and the driven unit from the second end of the coil spring.

13. The image forming apparatus according to claim 10, further comprising:

a driven gear coupled to a duplex roller of the duplex carrying unit; and a swing gear unit having a gear train supported on a swing gear unit frame, the gear train including a center gear configured to receive the driving power from the driving power source, a first number of first side gears on a first side of the center gear and a second number of second side gears on a second side opposite to the first side, the first number being different from the second number, the frame being configured rotate about an axis such that when the driving power is in the first direction the frame rotates to allow one of the first side gears to engage the driven gear to cause the duplex roller of the duplex carrying unit to rotate In the first direction, the frame being further configured rotate about the axis such that when the driving power is in the second direction the frame rotates to allow one of the second side gears to engage the driven gear to cause the duplex roller of the duplex carrying unit to rotate in the first direction.

14. The image forming apparatus according to claim 13, wherein:

the first number is an odd number, and wherein the second number is an even number.

15. The image forming apparatus according to claim 13, further comprising:

an alignment roller shaft supporting alignment rollers configured to align the printing medium prior to forming an image on the printing medium, wherein the center gear is coupled to, and rotates with, the alignment roller shaft.

16. A power transmission apparatus to transmit a driving power to at least first and second movable members of an image forming apparatus, the power transmission apparatus comprising:

a driving unit which receives the driving power from a driving power source and rotates in forward and backward directions;

a driven unit which transmits the driving power from the driving unit to the first movable member; and an elastic clutch including a coil spring which is wound in a direction of driving the first movable member in the forward direction and provided between the driving unit and the driven unit to transmit the driving power from the driving unit to rotate the first movable member in a first direction and to control the driving power not to rotate the first movable member in a second direction while the driving power from the driving unit rotates the second movable member in both the first and second directions, wherein the first movable member comprises a developing unit.

17. The power transmission apparatus according to claim 15, wherein the coil spring comprises a first end part coupled to one of the driving unit and the driven unit and a second end part press fitted to the other one of the driving unit and the driven unit.

18. The power transmission apparatus according to claim 17, wherein the second movable member comprises a duplex carrying unit.

19. An image forming apparatus comprising:

a developing unit which forms an image on a print medium;

a duplex carrying unit which returns the print medium, one side of which has a formed image, to the developing unit; and a power transmission apparatus which transmits driving power from a driving power source to rotate the developing unit in a forward direction and to rotate the duplex carrying unit in forward and backward directions, wherein the power transmission apparatus comprising a driving gear which rotates in the forward and backward directions by receiving the driving power from the driving power source and transmits the driving power to the duplex carrying unit;

a driven gear which transmits the driving power from the driving gear to the developing unit; and an elastic clutch including a coil spring which is wound in a direction of driving the developing unit in the forward direction and which is provided between the driving gear and the driven gear, transmits the driving power to rotate the driven gear in a forward direction and prevents the driven gear from rotating in a backward direction while the driving gear rotates in the backward direction.

20. The image forming apparatus according to claim 19, further comprising:

a frame which supports the driving power source; and a swing gear unit which is swingably provided in the frame, receives forward and backward rotations and transmits a rotation of a certain direction to the duplex carrying unit.

21. The image forming apparatus according to claim 20, further comprising:

a duplex roller which is provided in the duplex carrying unit and caries the print medium;

a swing driving gear which transmits the driving power from the driving power source to the swing gear unit; and a duplex gear which is provided on a rotational shaft of the duplex roller and receiving the driving power from the swing gear unit.

22. The image forming apparatus according to claim 21, wherein the swing gear unit comprises:

a swing member which is installed in the frame and swingable corresponding to the forward and backward rotations of the swing driving gear;

an even number of first swing gears each of which is provided in one side of the swing member and engaged with the duplex gear when the swing member swings in a first direction; and an odd number of second swing gears each of which is provided in the other side of the swing member and engaged with the duplex gear when the swing member swings in a second direction.

* * * * *